United States Patent [19]

Cranberg

[11] 4,119,858

[45] Oct. 10, 1978

[54] COMPACT LONG-LIVED NEUTRON SOURCE

[76] Inventor: Lawrence Cranberg, 1205 Constant Springs Dr., Austin, Tex. 78746

[21] Appl. No.: 713,402

[22] Filed: Aug. 11, 1976

[51] Int. Cl.[2] ..... G21G 4/02

[52] U.S. Cl. ..... 250/499; 250/502

[58] Field of Search ..... 250/499, 500, 502, 501

[56] References Cited

U.S. PATENT DOCUMENTS

| | | | |
|---|---|---|---|
| 2,993,996 | 7/1961 | Meyerhof | 250/502 |
| 3,389,257 | 6/1968 | Caldwell et al. | 250/499 |
| 3,968,377 | 7/1976 | Farrell | 250/499 |

*Primary Examiner*—Harold A. Dixon

[57] ABSTRACT

A compact apparatus with long lifetime for producing high-energy neutrons is described which is suitable for application to neutron well-logging and to activation analysis. It embodies a tritiated target bombarded by a beam of energetic deuterium ions, the ions passing through a magnetic field which rotates about the axis of the beam, thereby dispersing the ion beam into a plurality of ion beams, each with a single value of charge-to-mass ratio. Each of the separated beams impinges on a separate, concentric, annulus-shaped area of the target.

6 Claims, 3 Drawing Figures

COMPACT LONG-LIVED NEUTRON SOURCE

BACKGROUND OF THE INVENTION

1. Field.

This invention relates to electrical apparatus for generating high-energy neutrons. It relates in particular to apparatus for generating 14-Mev neutrons which apart from power supply is sufficiently compact to be used in a well-bore for well-logging, and which will deliver a high output of neutrons for extended periods when electrially energized.

2. Prior Art.

Much of the relevant prior art has been reviewed in the applicant's co-pending application, "Neutron Generator Apparatus and Method", Ser. No. 452,080, filed Mar. 18, 1974, which is incorporated herein by reference.

In that review, attention is focused on the methods and designs which have been evolved to provide a long-lived, high-intensity source of 14-Mev neutrons for the treatment of cancer, said neutrons being generated by the $T(d,n)He^4$ reaction, which is well known to the skilled artisan as the D-T reaction. In the problem of neutron well-logging, D-T neutrons are produced in a compact source which can operate down-hole in order to assess the properties of the materials surrounding the well-bore. Although the applications are widely different, the problems which limit the useful output of the neutron source, so far as intensity and lifetime are concerned, are basically similar. They fall under the two headings of thermal effects and dilution effects.

Targets for the production of D-T neutrons commonly consist of a chemical compound of tritium with a substance which forms a strong hydride bond such as zirconium, titanium, or scandium. These compounds are stable only over a limited temperature range. For titanium, for example, the compound dissociates at temperatures in excess of 200° C. It is necessary therefore to limit the temperature attained by the target. When the target is bombarded by deuterons to produce neutrons, the bombarded areas are often strongly heated. Hence, thermal effects are critical in determining the neutron output and useful lifetime of a target.

Many methods have been devised to control and to improve the thermal characteristics of the target. For example, it is common to support the target on a base of high thermal conductivity, such as a thin sheet of copper, and to cool the back of the copper base efficiently. And in the above-cited co-pending application, a novel, rotating target is described which deals effectively with the thermal problem by effectively spreading the beam over an extended area of target by rapidly rotating the target under the beam, successively exposing different areas of the target to the beam. Such a rotating target is inapplicable to the down-hole situation, where the diameter of the apparatus is constrained to be less than about 1.5 inches in diameter.

Another method of dealing with thermal effects and the less of tritium from the target resulting therefrom is to accelerate a mixture of tritium and deuterium ions, so that the target is continuously replenished by ions from the beam itself. While this method is effective in prolonging the life of the target, it is inherently much less efficient in the number of neutrons per second produced per watt of power dissipated in the target, compared to a system in which deuterium ions impinge on a tritiated target, and is limited in ouput by the electrical power available down-hole to neutron intensities in the range of $10^8$ per second. For the same power dissipation, with a deuterium ion beam incident on a tritiated target, the neutron output obtainable is estimated to be at least $10^9$ per second, and this is the level of performance which is being sought.

In addition to thermal effects, which cause progressive deterioration of a tritiated target, we must deal with what we have called "dilution" effects. The term "dilution" refers to the fact that as a tritiated target is bombarded by energetic deuterium ions, some of those ions displace atoms of tritium from the target, which then leave the target permanently. The resulting gradual depletion of the tritium content of the target causes a gradual reduction of the neutron yield of the target.

To clarify the dilution effect, it is necessary to take note of the fact that the beams of deuterium ions which are produced by conventional ion sources consist both of atomic and molecular species, in relative proportions which vary from one source to another, and are dependent on the operation conditions of a given source. Usually the dominant species are atomic ($D^+$) and diatomic ($D_2^+$), but ions of several more massive species may be present in minor quantities.

The distinction between atomic and molecular species is important because of associated differences in dilution effect. In particular, it is useful to distinguish between the effects of ions of a given species on neutron production by ions of the same species (self-dilution effect), and on those of a different species (cross-dilution effect).

In the work of J. H. Ormrod (Canadian Journal of Physics, 52, 1971 (1974)), it is shown with particular clarity that the dilution takes place primarily in a thin layer of the target at the end of the range of the projectile ions — that is, in the layer in which the projectiles are implanted. Since tritium is removed primarily from those layers in which the projectile ions are implanted, then the magnitude of the self-dilution effect is determined primarily by the magnitude of the probablility or cross section for production of a D-T neutron by a deuterium ion at or near the end of its range. This probability or cross section is very small, and therefore the self-dilution effect is very small. The situation is quite different, however, for the cross-dilution effect.

Let us consider the simplest, but practically the most important case of cross-dilution — namely, that involving only the atomic and the diatomic ions of deuterium. And let us assume that the ions impinge on the target after falling through a potential difference of 200 kev. The atomic ions will penetrate the target to a depth corresponding to the range of an atomic, 200 kev projectile of mass 2. The diatomic, mass-4 ions break up on entering the target into two atomic ions which share the energy of the diatomic ion equally, and thus penetrate the target with the energy of two, separate, 100 kev ions of mass 2. These ions will be implanted in a correspondingly shallower layer of the target. It is this shallower layer of the target which is depleted of its tritium in due course. But is so happens that the layer of the target which is depleted of tritium by ions which were originally diatomic is a layer traversed by atomic ions at an energy for which the neutron yield of the D-T reaction is near its maximum value. Thus, cross-dilution has a major effect on the neutron yield of a tritiated target bombarded simultaneously by atomic and diatomic ions which have fallen through the same potential difference.

In the prior patent application referenced above, a method of eliminating cross-dilution is disclosed without loss of ions or the associated neutron production. In that method, the deuterium ions are passed through a magnetic field of fixed direction perpendicular to the axis of the ion beam, causing the latter to be dispersed into a plurality of beams, each of a single mass species, in such manner that each species impinges a separate but adjacent area of target. To describe this general method of eliminating the cross-dilution effect, we shall use the term "co-analysis".

The method of co-analysis previously disclosed is one which is readily applicable to apparatus of relatively large scale, with a rotating target, such as is appropriate for therapy. In apparatus of small scale, however, such as is required for use down hole for well-logging, the use of a rotating target is impractical. As a practical matter, the target must be fixed and compact, preferably in the form of a disc or cone, not exceeding 1.5 inches in diameter. If a magnetic field of fixed direction is used to co-analyse an ion beam with such a target, the ions intersect the target in a narrow band, leaving most of the target unused, with all of the ion beam concentrated on a relatively small fraction of the area of the target, thereby heating it to correspondingly high temperature and shortening its life.

SUMMARY

Applicant solves the problem of producing a compact, long-lived D-T neutron source for well logging by providing a magnetic field which rotates about the axis of a beam of deuterium ions from an ion source, said axis being in the direction of motion of the ions, said magnetic field deflecting the ions according to their charge-to-mass ratio by small angles from the beam axis, but symmetrically thereto.

Applicant solves the problem of excessive temperature of the target causing thermal dissociation of the target compound with release of tritium therefrom by providing a circular target whose area is as large as is compatible with the confining conditions of the well bore, the center of the target coinciding with the axis of the deuterium ion beam and the axis of rotation of the magnetic field, so that the ion beam, under the action of the rotating magnetic field, impinges the target in a fairly uniform manner over its entire area.

Applicant solves the problem of cross-dilution of the ion beam by so adjusting the intensity, position, and extent of the magnetic field, and the focus of the ion beam in relation to the target, that before the ions impinge upon the target, they are deflected and separated into a plurality of beams, the most intense of which are mutually separated. The areas impinged by the beams are a set of concentric annuli centered on the point of intersection of the undeflected beam with the target. This system is inexpensive to design and manufacture and provides for an efficient and reliable use of ions from the ion source.

Thus, it is an object of this invention to produce a high flux of neutrons.

Another object of the invention is to provide an apparatus which increases the lifetime of a neutron-emissive target.

Another object of the invention is to provide an apparatus which produces neutrons at a rate in excess of $10^9$ per second, averaged over all solid angle.

Another object of the invention is to provide a long-lived neutron source of high-intensity which is sufficiently compact that it can be dropped down into and operated within a well-bore.

Another object of the invention is to prolong the life of the target of a neutron well-logging apparatus by separating by magnetic means the atomic and diatomic ions in the ion beam, so that for these more abundant species, ions only of a single mass impinge on a defined area of the target.

Another object of the invention is to prolong the life of the target of a neutron well-logging apparatus by reducing its temperature, said reduction being accomplished by spreading the ions over a target by means of a rotating magnetic field.

BRIEF DESCRIPTION OF THE DRAWINGS

The foregoing and other objects, features, and advantages of the invention will be apparent from the following more particular description of a preferred embodiment of the invention as illustrated in the accompanying drawings wherein like reference numerals indicate like parts in which.

DESCRIPTION OF THE PREFERRED EMBODIMENT

Figure 1:
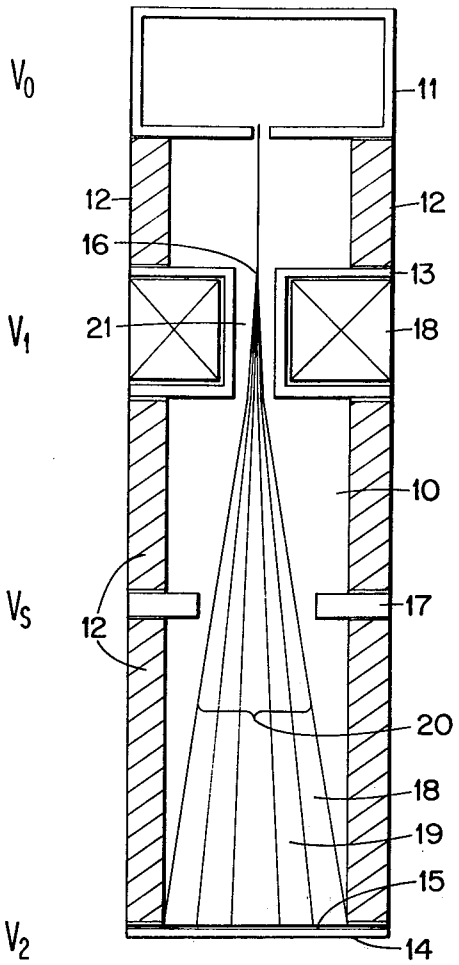
FIG. 1 is a partial sectional view of the preferred embodiment of the invention.

Referring to FIG. 1, the neutron generator occupies a cylindrically symmetric space 10, which is partially filled with deuterium gas at low pressure, which can be maintained by means of a replenisher, which may be considered a part of the ion source 11. This space 10 is defined by the inner surfaces of the ion source 11, electrical insulators 12, extraction electrode 13, target 15, and suppression electrode 17, all of which are bonded to each other by vacuum-tight seals against the external atmosphere. When connected to sources of electrical energy not shown, there is a controlled release of deuterium gas into the ion source 10, which then produces within its volume a quantity of deuterium ions from the gas. Some of these ions are extracted from the ion source by the electrical field sustained betwen the ion source 10 and the extraction electrode 13, when they are connected to appropriate sources of electrical energy not shown, which maintain the ion source at a potential $V_o$ and the extraction electrode at a lower potential $V_1$. The ions so extracted form a focused, cylindrically symmetric beam 16, as it passes along the axis of symmetry of the extraction electrode and through space 21, which is surrounded by the electrode 13 and by the electromagnet 18. Electromagnet 18 is constructed similarly to the stator of a polyphase induction motor, so that when energized by a source of polyphase power not shown, a magnetic field is created in space 21 whose direction rotates at a uniform rate about the axis of the electromagnet, which coincides with the axis of the ion beam. The frequency of rotation of the magnetic field is determined by the frequency of the polyphase power supplied to the electromagnet and the number of magnetic poles of the electromagnet. The effect of passage of the ion beam 16 through the magnetic field is to deflect the ions away from the axis of symmetry, the magnitude of the deflection being inversely proportional to the square-root of the mass of the ion, the atomic ions 18 being deflected most, the diatomic ions 19 next, and so forth. Thus, a plurality of beams 20 is formed, each of which consists predominantly of ions of a single mass, each beam sweeping out a cone of different inclination to the axis of symmetry. At the same time, the ions are given a final acceleration due to the potential difference between the focusing electrode 13 and the target 15 of tritiated titanium or scandium, which is in the form of a thin coating on target support 14, which is at potential $V_2$. The target support 14 is provided with suitable cooling means not shown. Electrode 17 is at a potential $V_s$ below the potential $V_2$ of the target 15, which is in electrical and thermal contact with the target support 14. Electrode 17 and its associated electrical field serves the purpose of suppressing electrons which otherwise would emanate from the target and would be accelerated up the device, undesirably loading its power supplies.

Figure 2:
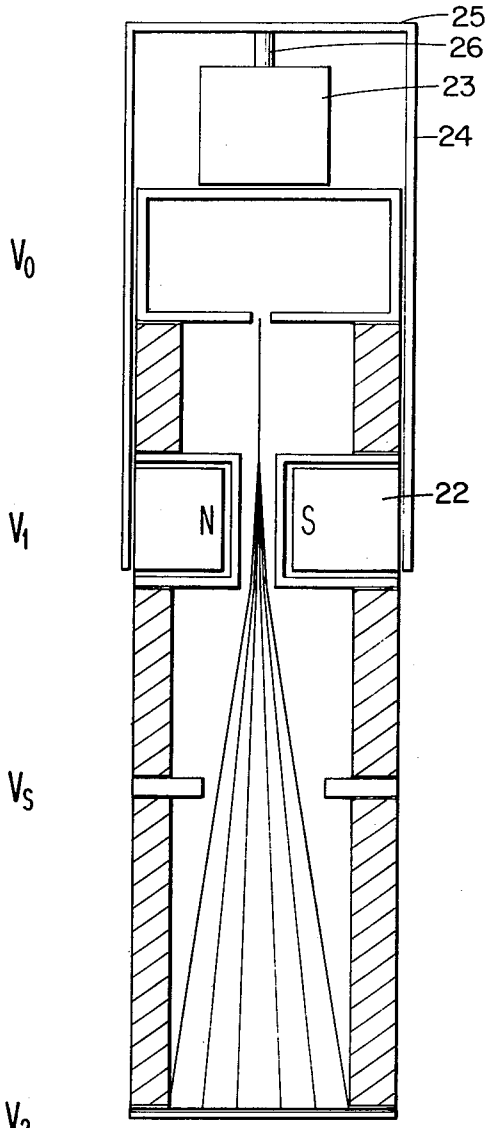
FIG. 2 is a partial sectional view of a first alternative embodiment of the invention.

In the alternative embodiment shown in FIG. 2, the magnetic field is provided by a magnetic dipole 22, which may be a permanent magnet or an electromagnet. Rotation of the magnetic field is accomplished by mechanically rotating the magnet by means of a drive collar 24, driving disc 25, shaft 26, all driven by motor 23. Driving disc 25 is fitted with slip rings not shown, through which electrical energy is fed to the ion source and electromagnet.

Figure 3:
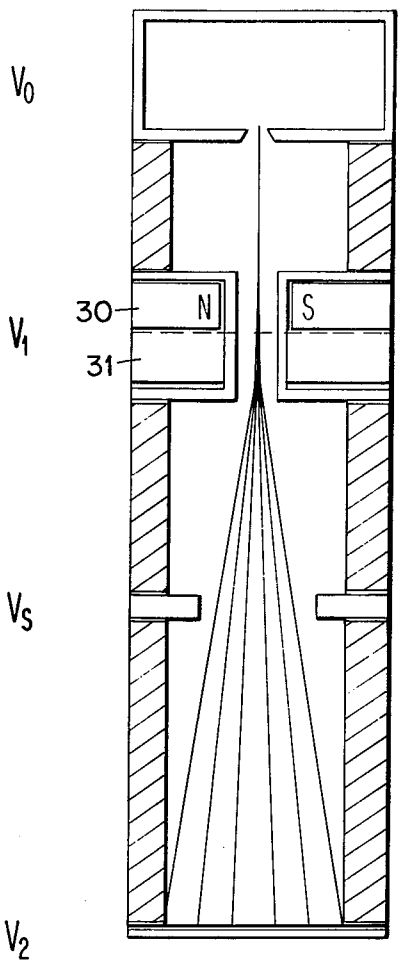
FIG. 3 is a partial sectional view of a second alternative embodiment of the invention.

In the alternative embodiment shown in FIG. 3, the magnetic field is provided by two electromagnets 30 and 31. Each magnet provides a magnetic field perpendicular to the beam axis and to the magnetic field of the other, when energized by means not shown. If the electrical energizing means is ac of the same frequency, but displaced in phase by 90°, then the combined effect of the two electromagnets 30 and 31 is that of a rotating magnetic field, which then acts on the beam as described above with respect to FIG. 1.

The foregoing disclosure and description of the invention are illustrative and explanatory thereof and various changes in relative size, shape, and materials as well as in details of the illustrated construction may be made without departing from the scope of the invention.

What is claimed is:

1. An apparatus for generating neutrons suitable for use in a well-bore comprising a source of deuterium ions, means for accelerating and focusing said ions to a target, means for supplying a magnetic field whose direction rotates about the direction of said ions as an axis, said magnetic field deflecting said ions according to their charge-to-mass ratio before said ions impinge said target, so that said ions impinge said target in a family of concentric annuli, each annulus being impinged by ions predominantly of a single value of charge-to-mass ratio, said target containing material which is neutron-emissive when impinged by deuterium ions.

2. Claim 1 wherein said means for supplying said rotating magnetic field is designed and constructed in accordance with the principles of the stator of a polyphase induction motor.

3. Claim 1 wherein said means for supplying said rotating magnetic field is a magnetic dipole which is rotated by electromechanical means about the direction of said ions as an axis.

4. Claim 1 wherein said means for supplying said rotating magnetic field is a pair of electromagnetic dipoles arranged so that the direction of the magnetic field provided by each is perpendicular to the direction of the magnetic field provided by the other and to the direction of said ions as said ions pass through said magnetic fields, said electromagnetic dipoles being energized by ac currents which are 90° out of phase with each other and of the same frequency.

5. Claim 1 wherein said neutron-emissive target is titanium tritide.

6. Claim 1 wherein said neutron-emissive target is scandium tritide.

* * * * *